US009627777B2

(12) United States Patent
Benzel et al.

(10) Patent No.: US 9,627,777 B2
(45) Date of Patent: Apr. 18, 2017

(54) BROAD BAND ANTENNAS AND FEED METHODS

(75) Inventors: David M. Benzel, Livermore, CA (US); Richard E. Twogood, San Diego, CA (US)

(73) Assignees: Lawrence Livermore National Security, LLC, Livermore, CA (US); Dirac Solutions, Inc., Pleasanton, CA (US)

( * ) Notice: Subject to any disclaimer, the term of this patent is extended or adjusted under 35 U.S.C. 154(b) by 220 days.

(21) Appl. No.: 13/572,234

(22) Filed: Aug. 10, 2012

(65) Prior Publication Data

US 2013/0038495 A1 Feb. 14, 2013

Related U.S. Application Data

(60) Provisional application No. 61/521,966, filed on Aug. 10, 2011.

(51) Int. Cl.
*H01Q 13/10* (2006.01)
*H01Q 21/08* (2006.01)
*H01Q 13/08* (2006.01)

(52) U.S. Cl.
CPC ..... *H01Q 21/08* (2013.01); *H01Q 13/085* (2013.01)

(58) Field of Classification Search
CPC .. H01Q 19/18; H01Q 21/064; H01Q 21/0031; H01Q 21/0067; H01Q 21/067; H01Q 21/28; H01Q 21/293; H01Q 5/0051; H01Q 5/0062; H01Q 9/0421; H01Q 9/16; H01Q 13/10; H01Q 15/10; H01Q 19/10; H01Q 13/085; H01P 5/10
USPC ..... 343/767, 770, 795, 807, 772
See application file for complete search history.

(56) References Cited

U.S. PATENT DOCUMENTS

| | | | | |
|---|---|---|---|---|
| 3,271,771 | A * | 9/1966 | Hannan et al. | 343/756 |
| 4,516,132 | A * | 5/1985 | Bond et al. | 343/815 |
| 4,843,403 | A * | 6/1989 | Lalezari et al. | 343/767 |
| 4,940,991 | A * | 7/1990 | Sheriff | 343/795 |
| 6,356,240 | B1 * | 3/2002 | Taylor | H01Q 21/24 343/767 |
| 6,778,145 | B2 * | 8/2004 | Toland | H01Q 13/085 343/767 |
| 6,911,951 | B2 * | 6/2005 | Dotto et al. | 343/767 |
| 7,088,300 | B2 * | 8/2006 | Fisher | 343/767 |
| 2002/0149529 | A1 * | 10/2002 | Fleming et al. | 343/767 |
| 2004/0021613 | A1 * | 2/2004 | Nesic et al. | 343/795 |
| 2005/0012672 | A1 * | 1/2005 | Fisher | H01Q 13/085 343/767 |
| 2005/0162332 | A1 * | 7/2005 | Schantz | 343/795 |

(Continued)

*Primary Examiner* — Dameon E Levi
*Assistant Examiner* — Hasan Islam
(74) *Attorney, Agent, or Firm* — John P. Wooldridge

(57) ABSTRACT

Two or more Vivaldi antennas, consisting of two plates each, each with the antenna's natural impedance of approximately 100 ohms, are placed in parallel to achieve a 50 ohm impedance in the case of two antennas or other impedances (100/n ohms) for more than two antennas. A single Vivaldi antenna plate (half Vivaldi antenna) over a ground plane can also be used to achieve a 50 ohm impedance, or two or more single plates over a ground plane to achieve other impedances. Unbalanced 50 ohm transmission lines, e.g. coaxial cables, can be used to directly feed, the dual Vivaldi (four plate) antenna in a center fed angled center departure, or more desirably, a center fed offset departure configuration.

16 Claims, 9 Drawing Sheets

(56) References Cited

U.S. PATENT DOCUMENTS

| | | | | |
|---|---|---|---|---|
| 2006/0273974 | A1* | 12/2006 | Bij De Vaate et al. | 343/770 |
| 2008/0198085 | A1* | 8/2008 | Hsu et al. | 343/795 |
| 2009/0262036 | A1* | 10/2009 | Thevenard et al. | 343/767 |
| 2010/0066622 | A1* | 3/2010 | Thevenard et al. | 343/770 |
| 2010/0145190 | A1* | 6/2010 | Bourqui et al. | 600/425 |
| 2011/0063181 | A1* | 3/2011 | Walker | 343/803 |
| 2011/0102284 | A1* | 5/2011 | Brown et al. | 343/767 |

* cited by examiner

BROAD BAND ANTENNAS AND FEED METHODS

RELATED APPLICATIONS

This application claims priority from Provisional Application Ser No. 61/521,966 filed Aug. 10, 2011, which is herein incorporated by reference.

GOVERNMENT RIGHTS

The United States Government has rights in this invention pursuant to Contract No. DE-AC52-07NA27344 between the U.S. Department of Energy and Lawrence Livermore National Security, LLC, for the operation of Lawrence Livermore National Laboratory.

BACKGROUND OF THE INVENTION

1. Field of the Invention

This invention pertains generally to broad band antennas, and more particularly to Vivaldi or tapered slot antennas and electrical feeds thereto and bandwidth and gain extension thereof.

2. Description of Related Art

Ultra-wideband (UWB) technology is increasingly being developed for communications and other applications. Unlike narrow band systems which operate at specific frequencies, UWB transmits and receives sequences of very short (typically 50-1000 ps) pulses, i.e. pulses spread over a very broad range or bandwidth (typically several GHz) of the electromagnetic spectrum. Improved antennas are needed to facilitate rf signal transmission and reception over a very broad band range.

The Vivaldi or tapered slot antenna has been known for some time, first being discussed in a 1979 IEEE European Microwave Conference paper by P. J. Gibson, "The Vivaldi Aerial." The antenna is described therein as "a new member of the class of aperiodic continuously scaled antenna structures, and as such, it has theoretically unlimited instantaneous bandwidth." The common feed method of microstrip and cavity matching is shown, which greatly limits bandwidth and efficiency.

As shown in FIG. 1, the prior art Vivaldi antenna 20 is generally formed of a pair of spaced conducting plates 22, 24 on a dielectric substrate 26. The plates 22, 24 are narrowly separated at the throat 28, where the electrical feed 30 is connected, and the gap 44 between the plates expands divergingly outwards along respective curved edges 32, 34 to the respective distal tips 36, 38 of the plates 22, 24. The feed 30 is generally formed of a coaxial cable 40 connected to plates 22, 24 through an impedance matching element or circuit 42.

When signals are propagated between different electrical elements, impedance matching is an important concern. If impedance is not matched, part of the signal is reflected at the interface, and power is lost. Coaxial cables having 50 ohm impedance are typically used to bring a signal to or from an antenna. Thus, ideally, the antenna should also have a 50 ohm impedance. But the Vivaldi antenna typically has an impedance of 100 ohms. This characteristic impedance has little sensitivity to plate thickness or spacing. Therefore a matching network or cavity or other matching element or circuit must be used. Matching the antenna's balanced impedance to standard unbalanced 50 ohm feed systems is often complex and difficult.

Accordingly it is desirable to provide an improved Vivaldi antenna structure having an impedance of 50 ohms, to allow direct feed from a 50 ohm coaxial cable.

BRIEF SUMMARY OF THE INVENTION

The invention places two or more Vivaldi antennas, consisting of two plates each, each with the antenna's natural impedance of approximately 100 ohms, in parallel to achieve a 50 ohm impedance in the case of two antennas or other impedances (100/n ohms) for more than two antennas. The invention can also be implemented using a single Vivaldi antenna plate (half Vivaldi antenna) over a ground plane to achieve a 50 ohm impedance, or two or more single plates over a ground plane to achieve other impedances. Unbalanced 50 ohm transmission lines, e.g., coaxial cables, can be used to directly feed the dual Vivaldi (four plate) antenna in a center fed angled center departure, or more desirably, a center fed offset departure configuration with negligible impact on impedance and pattern symmetry. An unbalanced 50 ohm feed can also be used for the half Vivaldi (single plate) ground plane antenna. In addition, a stub-plate or a reflector wire can be used to extend the low frequency bandwidth and gain for the antenna. A dual band method can also be used to extend the low frequency response and gain of the antenna.

An aspect of the invention is a dual Vivaldi antenna formed of a first Vivaldi subantenna and a second Vivaldi subantenna electrically connected in parallel to the first Vivaldi subantenna. The first and second subantennas are each formed of a first conductive plate and a second conductive plate supported in a spaced relationship to the first plate, the first and second plates defining a gap therebetween that is narrowest at a throat and increases along curved surfaces of the first and second plates to distal tips. The first plates of the first and second subantennas may be joined at a common edge, with the second plates of the first and second subantennas joined at a common edge, the first and second subantennas forming an angle therebetween. The first and second plates of the first subantenna may also be spaced and parallel to the first and second plates of the second subantenna, with first and second conducting strips connecting the first plates and second plates respectively. Additional subantennas may also be added. Stub plates, director elements and reflectors may also be used in combination with the antenna.

Another aspect of the invention is a coaxial feed cable directly connected to the antenna, i.e. having its center conductor directly connected to the first plates and its outer conductor directly connected to the second plates at points at the throat of the subantennas. The outer conductor may extend along the second plates for a distance about one third of the height of the second plates and then extend rearwardly, or the cable may extend away from the throat at angles to the subantennas.

A further aspect of the invention is a half Vivaldi antenna, formed of a ground plane; and a first conductive plate supported in a spaced relationship to the ground plane, the first plate and ground plane defining a gap therebetween that is narrowest at a throat and increases along a curved surface of the first plate to a distal tip.

Further aspects of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIGS. 2A-C through FIG. 14. It will be appreciated that the apparatus may vary as to configuration and as to details of the parts, without departing from the basic concepts as disclosed herein.

Figure 2A:
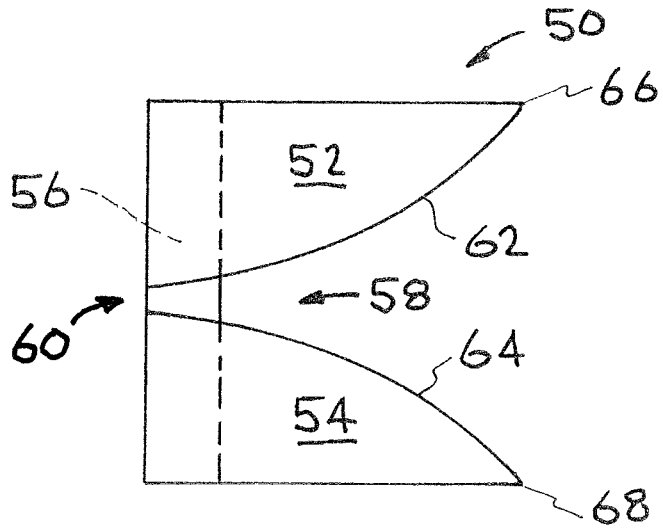
FIGS. 2A, B are side and top views of a two plate ISA embodiment of the invention
Figure 2B:
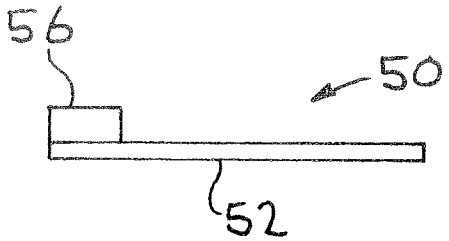
FIG. 2C illustrates the direct coaxial cable electrical feed thereto.
Figure 7:
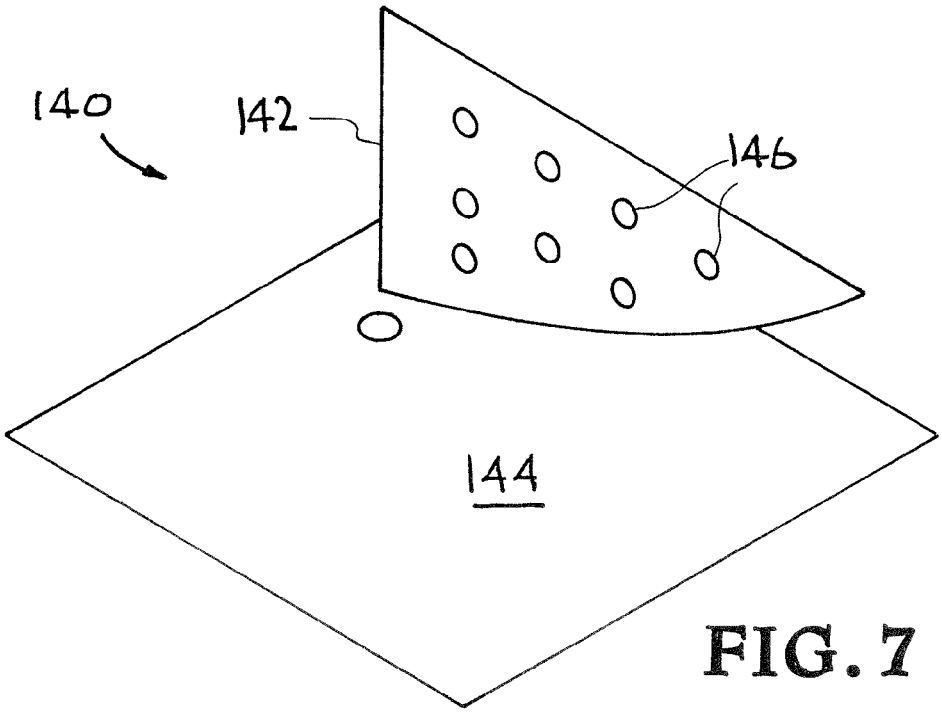
FIGS. 7, 8 show "half Vivaldi" antennas of the invention having a single plate of a Vivaldi antenna over a ground plane.
Figure 8:
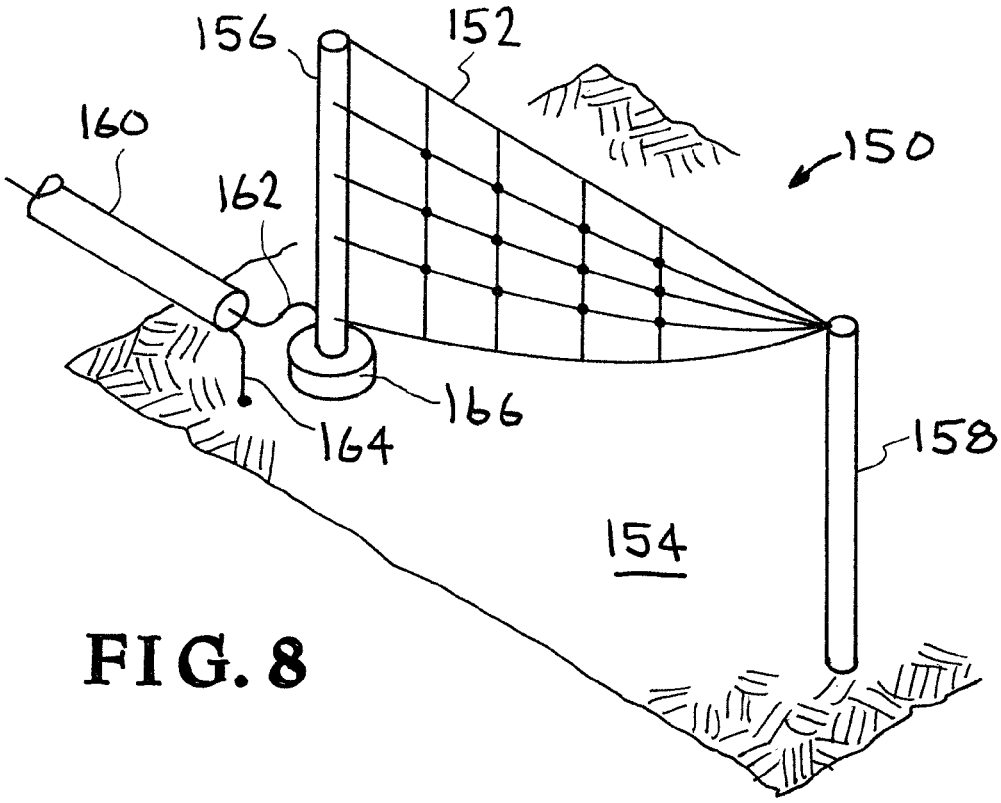

A simple Vivaldi antenna 50 of the invention, shown in FIGS. 2A, B, has a pair of (first and second, upper and lower, or top and bottom) spaced plates 52, 54, which are attached to a vertical dielectric support or strip 56. Strip 56 represents any means to support plates 52, 54 is the desired spaced relationship. The gap 58 between the pair of plates is narrow at the throat 60, and increases along the length of the curved edges 62, 64, to the distal ends or tips 66, 68. Plates 52, 54 may be solid, or may be perforated with holes (as shown in FIG. 7), or may be formed, of a wire mesh (as shown in FIG. 8). As used herein, Vivaldi antenna and tapered slot antenna (TA) are synonymous.

Figure 2C:
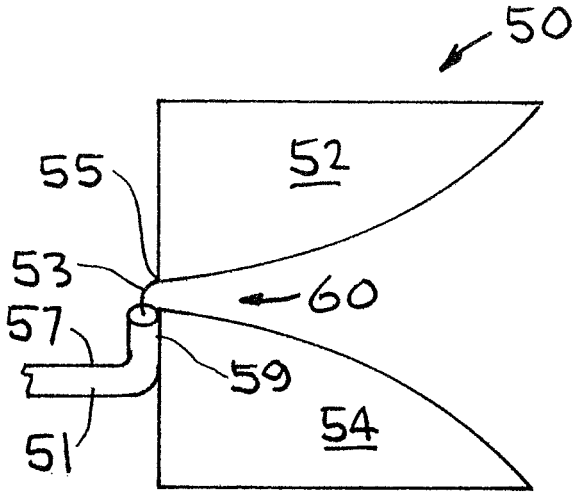

FIG. 2C shows the electrical feed to antenna 50 of FIGS. 2A, (support 56 is not shown). Coaxial cable 51 is directly connected to antenna 50. Center conductor 53 of cable 51 is connected to plate 52 at a feed point 55 near the throat 60 of the antenna. Outer conductor 57 is connected to the plate 54 across the throat 60 from feed point 55 along edge 59 of plate 54. Outer conductor 57 contacts edge 59 of plate 54 for a distance of about one third the height of the plate 54, then bends away therefrom.

Figure 1:
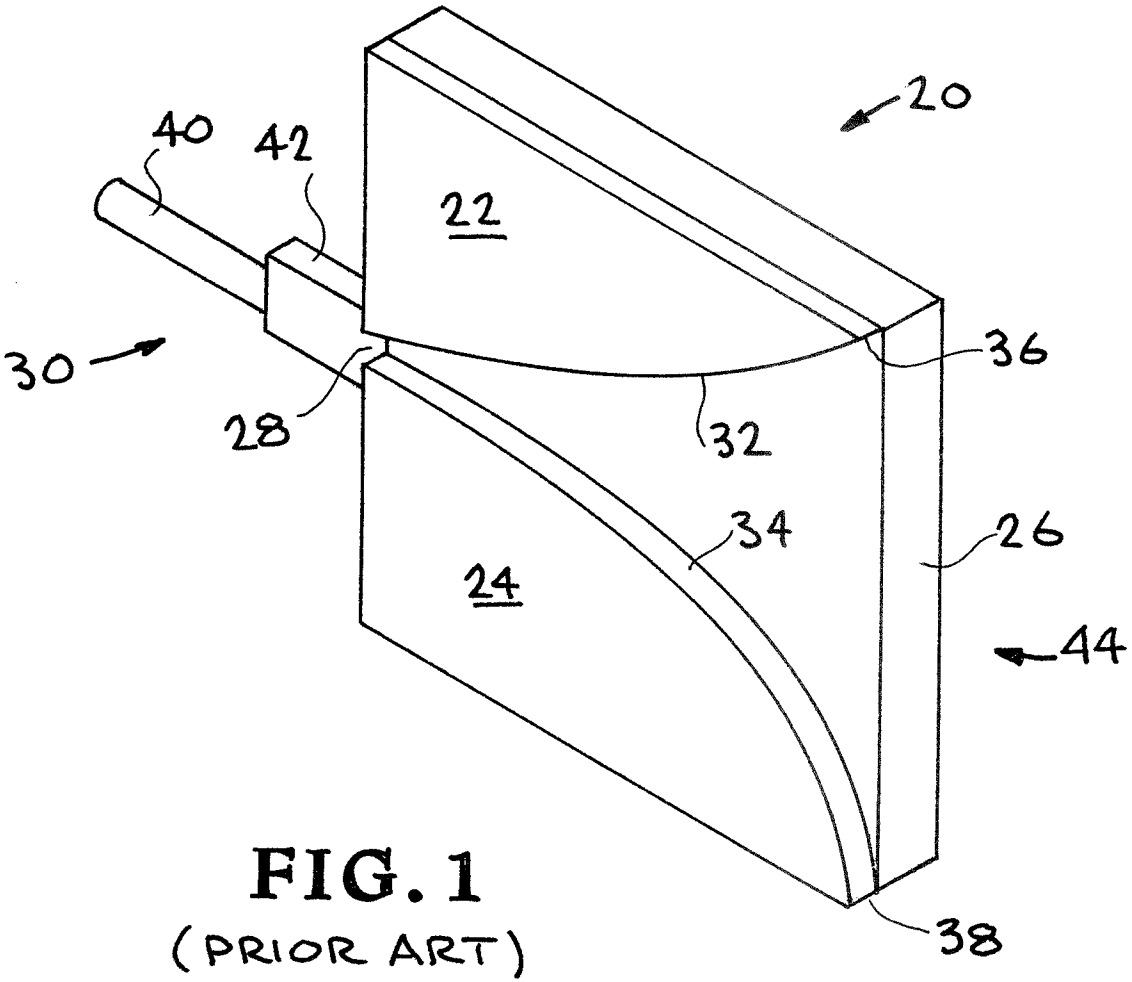
FIG. 1 (PRIOR ART)
FIG. 1 is a perspective view of a prior art Vivaldi or tapered slot antenna (TSA).
Figure 3A:
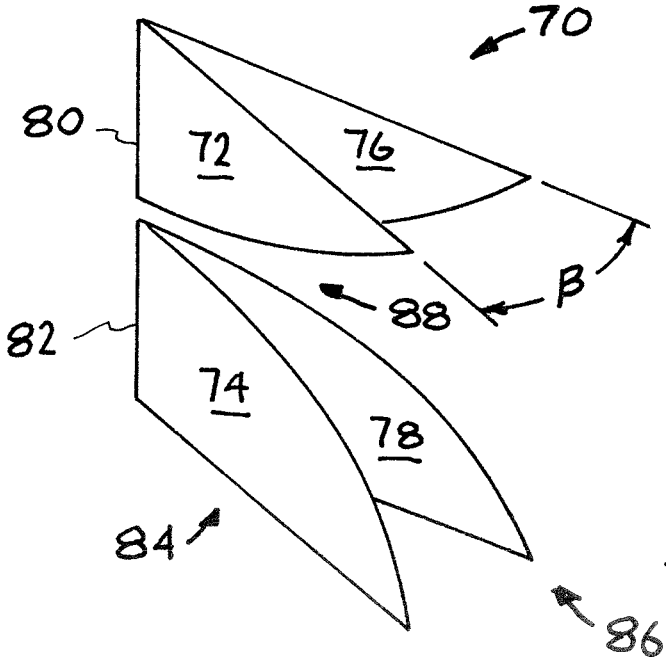
FIGS. 3A, B are perspective views of alternate embodiments of a dual Vivaldi antenna of the invention.

Dual Vivaldi antennas of the invention, having 50 ohm impedances, are shown in FIGS. 3A, B. These dual antennas are formed of two subantennas, each having two plates, connected in parallel. Each subantenna is essentially a prior art single Vivaldi antenna. Dual Vivaldi antenna 70, shown in FIG. 3A, is formed of a first pair of plates 72, 74 (forming a first antenna 84), and a second pair of plates 76, 78 (forming a second antenna 86). Plates 72, 76 are joined at a common edge 80, and plates 74, 78 are joined at a common edge 82. The plates 72, 74, 76, 78 are attached to a dielectric support (not shown) to form antennas 84, 86, i.e. to maintain them in the desired spaced relationship, defining an expanding gap 88 therebetween, as was indicated in FIGS. 1 or FIG. 2A. The support may take any form, e.g. a strip or a slab, and may be relatively small. The dielectric material of any support is used only for mechanical support and does not otherwise form a part of the antenna. The supports are omitted in all further drawings. The antennas 84, 86 (plates 72, 74 and plates 76, 78) are positioned or diverge at an angle β from each other.

Figure 3B:
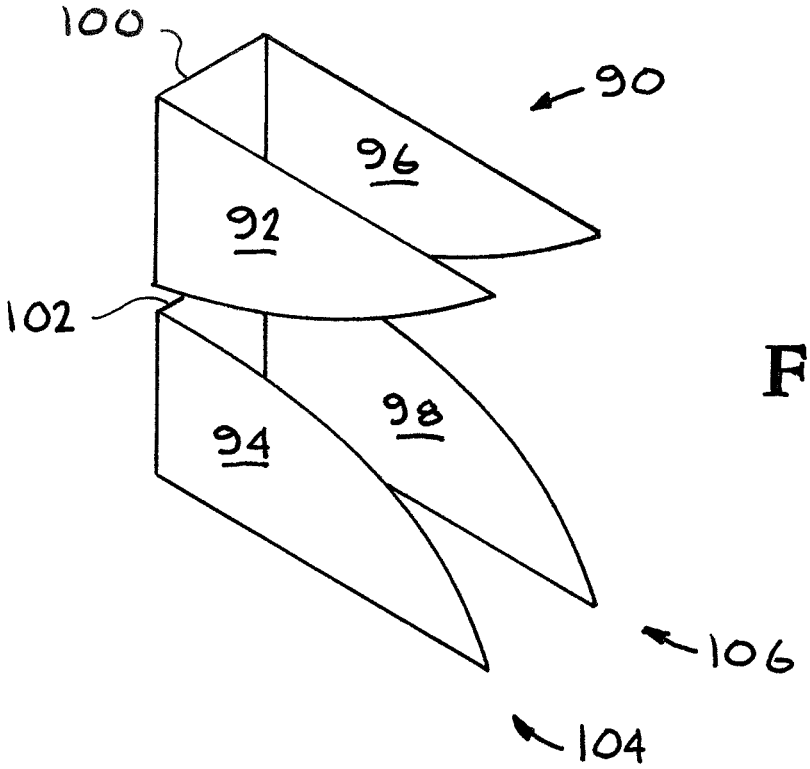

Dual Vivaldi antenna 90, shown in FIG. 3B, is formed of a first pair of plates 92, 94 (forming a first antenna 104), and a second pair of plates 96, 98 (forming a second antenna 106). Plates 92, 96 are spaced and parallel, and both are joined to a connecting strip 100, and plates 94, 98 are similarly spaced and parallel and joined to a connecting strip 102. The plates 92, 94, 96, 98 are attached to a dielectric support (not shown) to form antennas 104, 106, i.e. to maintain them in the desired spaced relationship, as was indicated in FIG. 1. The support may take any form, e.g. a strip or a slab. The two antennas 104, 106 (plates 92, 94 and plates 96, 98) are parallel and spaced apart from each other.

Figure 4:
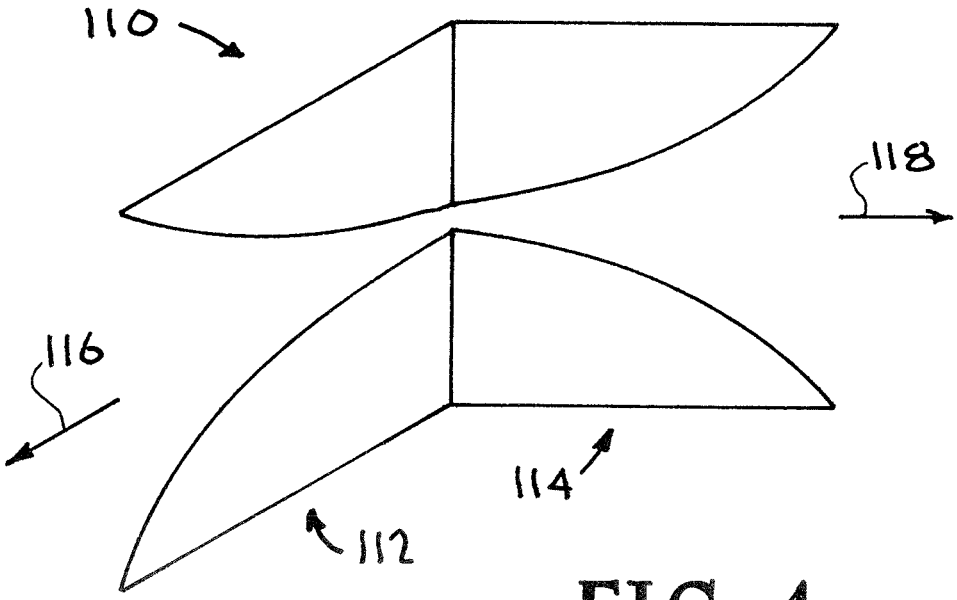
FIG. 4 is a perspective view of a dual Vivaldi antenna similar to FIG. 3A but having a much greater angle between the antennas.

FIG. 4 shows a dual Vivaldi antenna 110 of the invention which is similar to antenna 70 of FIG. 3A except that the angle β is very large. Thus signals are propagated from antenna 110 in directions represented by arrows 116, 118 that are greatly divergent.

Figure 5:
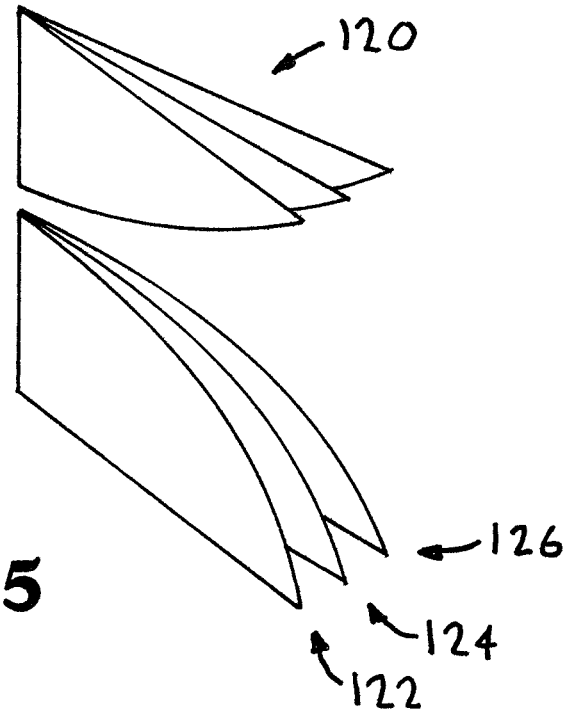
FIG. 5 is a perspective view of a triple Vivaldi antenna of the invention.

Similarly to the dual Vivaldi antenna, other impedances of 100/n ohms can be produced using "n" Vivaldi antennas in parallel. For example, a triple Vivaldi antenna 120, made up of three antenna 122, 124, 126 arranged in an angularly diverging configuration as in FIG. 3A, is shown in FIG. 5. Of course, a parallel arrangement of multiple antennas as in FIG. 3B could also be used.

Figure 6A:
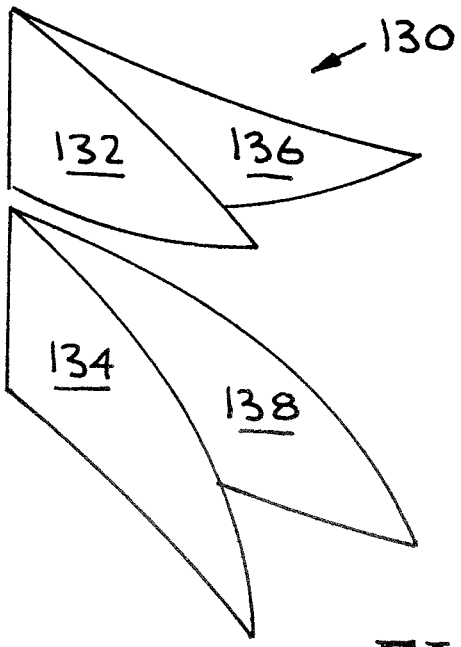
FIGS. 6A, are perspective and top views of a dual Vivaldi antenna of the invention having curved rather than flat plates.
Figure 6B:
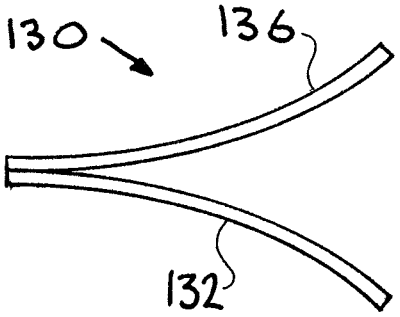

While the plates in the various Vivaldi antennas of the invention previously described have had flat plates, the plates may also be curved. FIGS. 6A, show a dual Vivaldi antenna 130 of the invention made up of plates 132, 134 (first antenna) and plates 136, 138 (second antenna) where the plates curve laterally outward.

While each of the Vivaldi antennas of the invention previously described have had two plates per antenna, a half Vivaldi antenna of the invention can be formed of a single plate of a Vivaldi antenna over a full or partial ground plane. Since a two plate antenna has a natural impedance of 100 ohms, a single plate antenna will have a 50 ohm impedance. Thus the single plate antenna can be fed directly with a 50 ohm coaxial cable. FIG. 7 shows a single plate Vivaldi antenna 140 of the invention having a single plate 142. Plate 142 is supported (support not shown) over a ground plane 144, e.g. a metal plate. Antenna plate 142 is shown not as a solid plate but as a plate having a plurality of holes or perforations 146 formed therein. FIG. 8 shows another single plate Vivaldi antenna 150 of the invention having a single plate 152 formed of a wire mesh. The ground plane is the earth 154. Wire mesh plate 152 is supported over ground 154 at the feed end by a conductive support 156, e.g. a conducting rod or post, and at the opposed end (tip) by a nonconductive support 158, e.g. a nonconducting rod or pole. Conductive support 156 is isolated from earth (ground plane) 154 by an insulator 166. The electrical feed connection of coaxial cable 160 to antenna plate 152 is shown. The center conductor 162 of coaxial cable 160 is directly connected to conducting rod 156 (and thus to wire mesh plate 152) while the outer conductor 164 of cable 160 is grounded (to earth 154). The half Vivaldi antennas may have additional single plates electrically connected in parallel.

Figure 9:
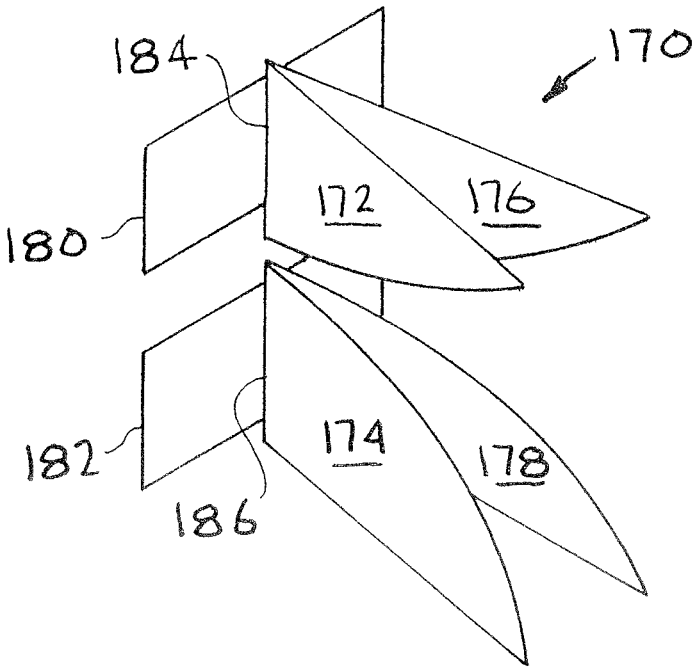
FIG. 9 shows a dual Vivaldi antenna of the invention with a pair of stub plates.

A Vivaldi antenna operates in standard "tapered slot mode" from a lowest frequency defined by the height of the antenna (generally 0.53λ where λ is the wavelength of the lowest frequency). The Vivaldi structure also exhibits a relatively closely matched impedance at a frequency defined by the length of the diagonal from the feed point to each furthest corner (tip). In another aspect of the invention, a pair of stub plates (or a single stub plate in the case of a half Vivaldi) are used to match the impedance over the frequency range from "lowest tapered slot mode" down to "diagonal dipole mode" in order to extend low frequency bandwidth by at least a factor of 2. As shown in FIG. 9, a dual Vivaldi antenna 170 of the invention is formed of plates 172, 174 (first antenna) and plates 176, 178 (second antenna) similar to FIG. 3A. Plates 172, 176, are joined at a common edge 184, and plates 174, 178 re joined at a common edge 186. Stub plates 180, 182 are joined to edges 184, 186 respectively. The stub plates are conductive plates.

Figure 10:
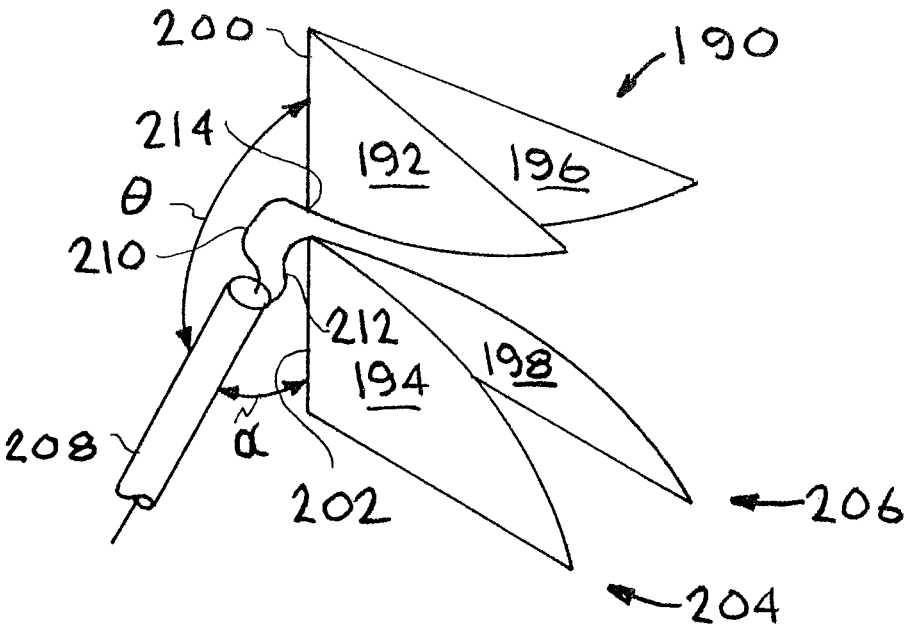
FIG. 10 shows the details of the direct feed of a dual Vivaldi antenna of the invention by a 50 ohm coaxial cable.

One advantage of the Vivaldi antenna configurations of the invention is the ability to make a direct feed connection to a standard 50 ohm coaxial cable. This direct feed connection is shown in FIG. 10. Dual Vivaldi antenna 190 is similar to antenna 70 in FIG. 3A and has a first pair of plates 192, 194 forming a first antenna 204, and a second pair of plates 196, 198 forming a second antenna 206. Plates 192, 196 are joined at a common edge 200, and plates 194, 198 are joined at a common edge 202. The support structure holding the plates in a spaced relationship is again not shown. Coaxial cable 208 is directly connected to antenna 190. Center conductor 210 of cable 208 is connected to edge 200 at a feed point 214 near the throat of the antenna. Outer conductor 212 is connected to the edge 202 at a feed point across the throat from feed point 214. Cable 208 extends from antenna 190 at a shallow angle α and a wide angle θ.

Figure 11:
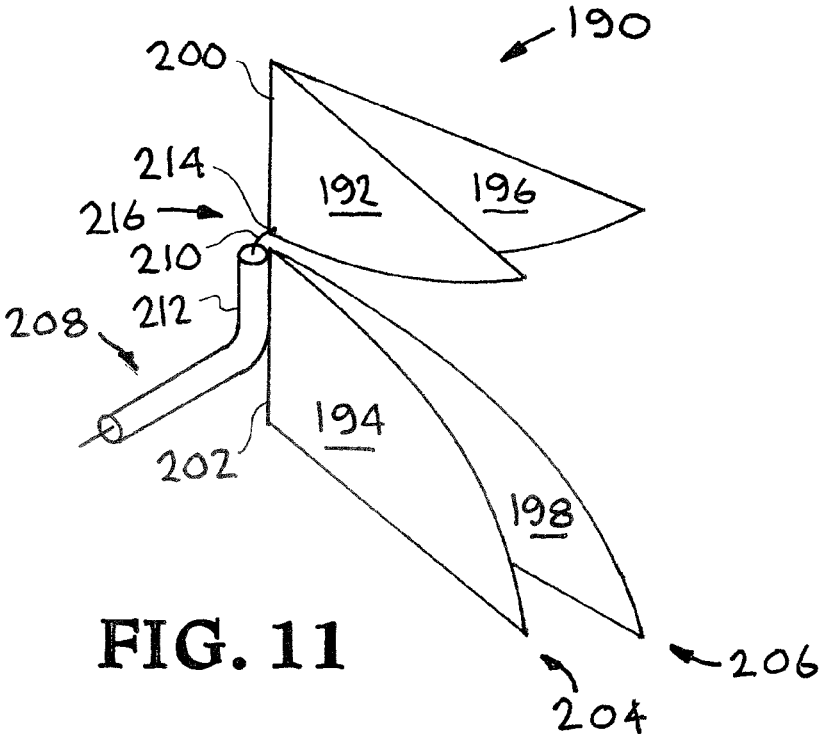
FIG. 11 shows the details of an alternate direct feed of a dual Vivaldi antenna of the invention by a 50 ohm coaxial cable.

An alternate direct feed connection of cable 208 to antenna 190 of FIG. 10 is shown in FIG. 11 (and is similar to the connection shown in FIG. 2C). Again, dual Vivaldi antenna 190 is similar to antenna 70 in FIG. 3A and has a first pair of plates 192, 194 forming a first antenna 204, and a second pair of plates 196, 198 forming a second antenna 206. Plates 192, 196 are joined at a common edge 200, and plates 194, 198 are joined at a common edge 202. The support structure holding the plates in a spaced relationship is again not shown. Coaxial cable 208 is directly connected to antenna 190. Center conductor 210 of cable 208 is connected to edge 200 at a feed point 214 near the throat of the antenna. Outer conductor 212 is connected along part of the edge 202 across the throat 216 from feed point 214. Outer conductor 212 is connected to edge 202 for approximately one third the height of plate 194 (or 198), and then cable 208 extends rearwardly away from antenna 190. Both FIGS. 10, 11 show center fed configurations. FIG. 10 shows the cable angled away directly from the center, with good results FIG. 11 shows the cable departing from the plate about ⅓ of the way down, with better results.

Either of the feed configurations shown in FIGS. 10, 11 can be used with no measurable VSWR or radiation pattern disturbance at the mid and high frequencies, and only minor pattern disturbance at the lowest frequencies. Coaxial cable is used as a direct feed: there is no matching network or cavity of any kind. Bandwidth is extremely high using the substrate-less antenna of the invention with direct feed, e.g. 50:1 with a VSWR of less than 1.3:1 and with very little criticality of physical dimensions. Bandwidths of greater than 100:1 can be achieved with simple attention to feed point geometry and dimensions, and with simple capacitive cancellation of feed-point inductance.

Figure 12:
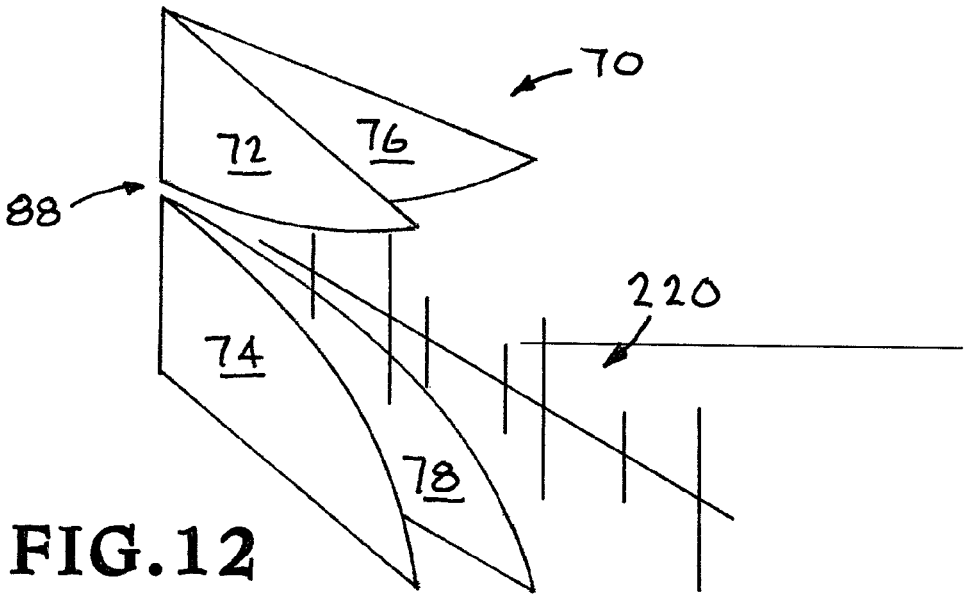
FIG. 12 shows a dual Vivaldi antenna of the invention with director elements.

Any of the above described Vivaldi configurations can be used as a very broadband driver element feed for director elements. As shown in FIG. 12, an antenna 70 as shown in FIG. 3A, provides the feed to director elements 220. The director elements 220 are positioned in and extend outwardly from the gap 88 defined between 72, 76 and plates 74, 78. Directors are employed along the lines of a Yagi-Uda (or Yagi) design, with the narrowband driven element replaced with an UWB Vivaldi antenna.

Figure 13:
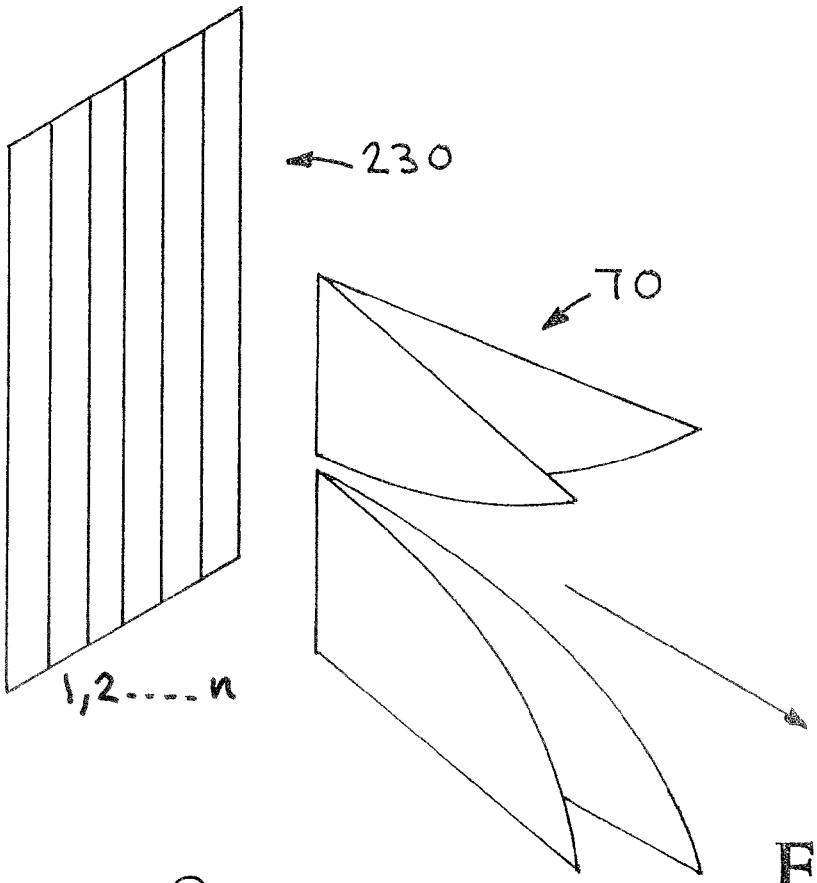
FIG. 13 shows a dual Vivaldi antenna of the invention with wire reflector elements.

A reflector element or a plurality thereof may also be used in accordance with the invention to match the impedance over the frequency range from the lowest tapered slot mode down to the diagonal dipole mode in order to extend the low frequency bandwidth by at least a factor of 1.5. In addition, the reflector element(s) also increase forward antenna gain at the low frequency end of the tapered slot mode as well as through the diagonal dipole mode. As shown in FIG. 13, a dual Vivaldi antenna 70 as shown in FIG. 3A, is positioned in front of reflector 230, e.g. n parallel wires. Reflector 230 may also be a solid plate.

Figure 14:
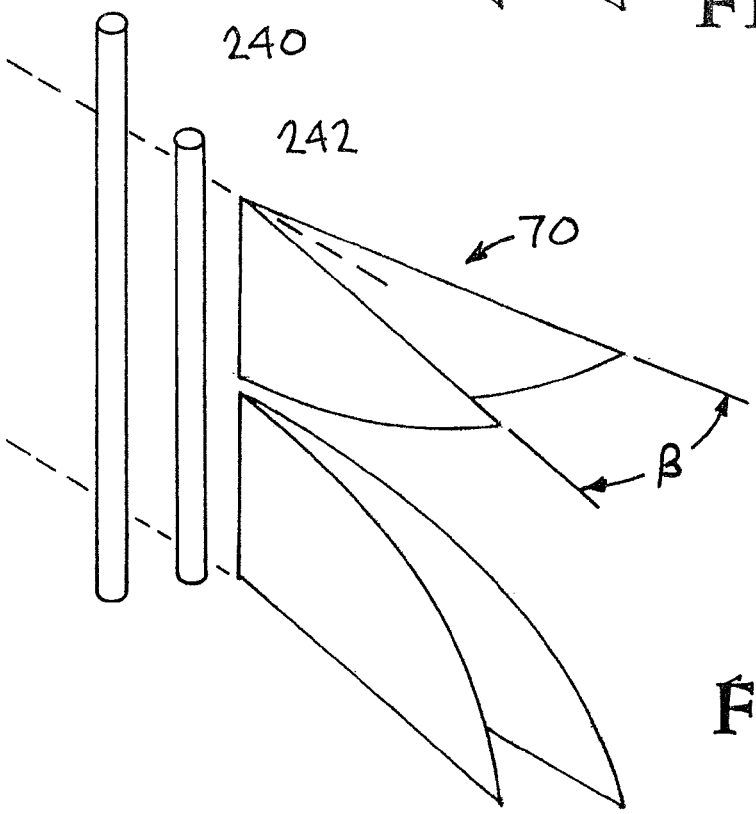
FIG. 14 shows a Vivaldi antenna the invention with a pair of reflectors of different length.

A reflector or a plurality of reflectors, each slightly longer than half the wavelength at their respective frequencies, can be added to increase forward gain and/or front/back (f/b) ratio. As shown in FIG. 14, a dual Vivaldi antenna 70 as shown in FIG. 3A is positioned in front of a pair of reflectors 240, 242 which are in the form of conducting rods. A longer reflector 240 enhances gain and/or f/b ratio at the angled dipole mode. A shorter reflector 242 enhances gain and/or f/b ratio in the Vivaldi mode, typically at the lowest frequency. Either reflector 240, 242 can be used separately, or both can be used together. Thus the antenna can generally be used in a two band mode.

Thus the invention provides an improved broad band antenna for UWB communications and other applications. The invention includes a dual Vivaldi or tapered slot antenna that places the pairs of spaced conducting plates of a pair of prior art Vivaldi antennas in a parallel configuration. The dual Vivaldi antenna is formed without a dielectric substrate as an essential part of the antenna; any dielectric material is used only as a structural support to hold the conducting antenna plates in the proper geometric configuration. The dual Vivaldi antenna configuration reduces the antenna impedance to 50 ohms, thereby facilitating direct feed connections to 50 ohm coaxial cables without any impedance matching elements or circuits. Additional pairs of Vivaldi plates can also be placed in parallel with the dual antenna to form an multiple antenna. The invention also includes a ground plane and a single Vivaldi antenna plate or multiple single antenna plates connected in parallel and positioned over the ground plane. The gain and low frequency bandwidth may also be increased by the addition of stub plates or reflectors.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present invention, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

What is claimed is:

1. A dual Vivaldi antenna, comprising:

a first Vivaldi subantenna having a first conductive plate and a second conductive plate supported in a spaced relationship to the first plate, wherein the first conductive plate and the second conductive plate do not touch each other at any place; and a second Vivaldi subantenna electrically connected in parallel to the first Vivaldi subantenna and having a third conductive plate and a fourth conductive plate supported in a spaced relationship to the third plate, wherein the third conductive plate and the fourth conductive plate do not touch each other at any place;

wherein the first conductive plate and second conductive plate have a first gap therebetween that is narrowest at a first throat and increases along curved surfaces of the first conductive plate and second conductive plate to their respective distal tips, the third conductive plate and fourth conductive plate have a second gap therebetween that is narrowest at a second throat and increases along curved surfaces of the third conductive plate and fourth conductive plate to their respective distal tips, the first conductive plate and the third conductive plate being physically and electrically connected together, and the second conductive plate and the fourth conductive plate being physically and electrically connected together, wherein said first Vivaldi subantenna and said second Vivaldi subantenna do not include any dielectric material.

2. The antenna of claim 1, wherein the first conductive plate, the second conductive plate, the third conductive plate and the fourth conductive plate are solid plates, perforated plates, or wire mesh plates.

3. The antenna of claim 1, wherein the first conductive plate and the third conductive plate are joined at a first common edge and form a first angle of less than 90 degrees therebetween, and the second conductive plate and the fourth conductive plate are joined at a second common edge and form a second angle of less than 90 degrees therebetween.

4. The antenna of claim 1, wherein the first conductive plate and the second conductive plate of the first subantenna are spaced and parallel to the third conductive plate and the fourth conductive plate of the second subantenna.

5. The antenna of claim 1, further comprising a coaxial feed cable having its center conductor directly connected to the first plate and the third plate, wherein the coaxial feed cable has its outer conductor directly connected to the second plate and the fourth plate.

6. The antenna of claim 5, wherein the center conductor is connected to the first plate and the third plate at the throat and outer conductor is connected to the second plate and the fourth plate at the throat.

7. The antenna of claim 6, wherein the outer conductor extends along the second conductive plate and the fourth conductive plate for a distance about one third their height and then extends rearwardly.

8. The antenna of claim 6, wherein the cable extends away from the throat at an angle to said first Vivaldi subantenna and said second Vivaldi subantenna.

9. The antenna of claim 1, further comprising at least one additional Vivaldi subantenna substantially identical to said first subantenna and said second Vivaldi subantenna and connected electrically in parallel with the first Vivaldi subantenna and the second Vivaldi subantenna, each additional Vivaldi subantenna being formed of a spaced first additional conductive plate and a second additional conductive, wherein the first additional conductive plate and the second additional conductive plate do not touch each other at any place and are separated by a tapered gap, the first additional plate of each additional Vivaldi subantenna being physically and electrically connected to the first plate and the third plate, and the second additional plate of each additional Vivaldi subantenna being physically and electrically connected to the second plate and the fourth plate.

10. The antenna of claim 1, wherein the first conductive plate, the second conductive plate, the third conductive plate and the fourth conductive plate are flat.

11. The antenna of claim 1, wherein the first conductive plate, the second conductive plate, the third conductive plate and the fourth conductive plate are curved.

12. The antenna of claim 1, further comprising a first conductive stub plate connected to the first conductive plate and the third conductive plate and a second conductive stub plate connected to the second conductive plate and the fourth conductive plate.

13. The antenna of claim 1, further comprising director elements positioned in and extending outwardly from the gap.

14. The antenna of claim 1, further comprising one or more reflector elements positioned behind the antenna.

15. The antenna of claim 14, wherein the one or more reflector elements comprises a plurality of parallel wires or a solid plate.

16. The antenna of claim 14, wherein the one or more reflector elements are selected from a plurality of conductive rods of various lengths, each slightly longer than half the wavelength of a respective frequency.

* * * * *